US007219838B2

(12) United States Patent
Brewster et al.

(10) Patent No.: US 7,219,838 B2
(45) Date of Patent: May 22, 2007

(54) SYSTEM AND METHOD FOR NOTIFYING A CASHIER OF THE PRESENCE OF AN ITEM IN AN OBSCURED AREA OF A SHOPPING CART

(75) Inventors: David Brewster, Toronto (CA); Paul Howell, Orillia (CA)

(73) Assignee: Howell Data Systems, Vaughn (CA)

( * ) Notice: Subject to any disclaimer, the term of this patent is extended or adjusted under 35 U.S.C. 154(b) by 158 days.

(21) Appl. No.: 10/914,140

(22) Filed: Aug. 10, 2004

(65) Prior Publication Data

US 2006/0032914 A1 Feb. 16, 2006

(51) Int. Cl.
*G06K 15/00* (2006.01)
*G06K 5/00* (2006.01)

(52) U.S. Cl. ..... 235/383; 235/382

(58) Field of Classification Search ..... 235/383, 235/385, 375, 379, 380, 382; 382/171, 155, 382/165, 100

See application file for complete search history.

(56) References Cited

U.S. PATENT DOCUMENTS

| | | | | |
|---|---|---|---|---|
| 3,725,894 | A | 4/1973 | Geisler | |
| 4,237,483 | A | 12/1980 | Clever | |
| 4,338,594 | A | 7/1982 | Holm | |
| 4,725,822 | A | 2/1988 | Hooley | |
| 5,481,622 | A * | 1/1996 | Gerhardt et al. | 382/103 |
| 5,485,006 | A | 1/1996 | Allen et al. | |
| 5,883,968 | A * | 3/1999 | Welch et al. | 382/100 |
| 5,910,769 | A * | 6/1999 | Geisler | 340/568.5 |
| 5,918,211 | A * | 6/1999 | Sloane | 705/16 |
| 5,965,861 | A | 10/1999 | Addy et al. | |
| 6,056,087 | A | 5/2000 | Addy et al. | |
| 6,105,866 | A | 8/2000 | Morrison et al. | |
| 6,378,684 | B1 * | 4/2002 | Cox | 194/213 |
| 6,540,137 | B1 * | 4/2003 | Forsythe et al. | 235/383 |
| 6,542,079 | B1 | 4/2003 | Kahl, Sr. | |
| 2003/0075602 | A1 | 4/2003 | Wike, Jr. et al. | |
| 2003/0098910 | A1 | 5/2003 | Kim | |
| 2003/0120547 | A1 | 6/2003 | Walter et al. | |
| 2003/0151219 | A1 * | 8/2003 | Simard | 280/47.35 |
| 2003/0184440 | A1 | 10/2003 | Ballantyne | |
| 2005/0173527 | A1 * | 8/2005 | Conzola | 235/385 |
| 2005/0189411 | A1 * | 9/2005 | Ostrowski et al. | 235/383 |

FOREIGN PATENT DOCUMENTS

| | | |
|---|---|---|
| CA | 2283382 | 12/1999 |
| CA | 2423205 | 9/2003 |

* cited by examiner

*Primary Examiner*—Thien M. Le
(74) *Attorney, Agent, or Firm*—Jonathan Pollack; Gowling Lafleur Henderson LLP

(57) ABSTRACT

A method of facilitating a checkout at a shopping cart checkout station is provided, comprising the steps of: inhibiting processing of items on the shopping cart in the event of a detection of a non-empty obscured section of the shopping cart; and processing the items upon receipt of a command input from an operator at the checkout station. A checkout station and apparatus for implementing the method are also provided.

38 Claims, 3 Drawing Sheets

SYSTEM AND METHOD FOR NOTIFYING A CASHIER OF THE PRESENCE OF AN ITEM IN AN OBSCURED AREA OF A SHOPPING CART

The present invention relates generally to an improved system and method for notifying a cashier if an item is present in an obscured area of a shopping cart.

BACKGROUND OF THE INVENTION

Bottom of Buggy (BOB) is a common grocery and general retail industry term. BOB is a key phrase that retail managers use to express their desire for cashiers to pay close attentions to a bottom storage area of shopping carts in order to spot items that need to be processed through the cash register or other point of sales terminal.

Point of sales terminals are known in the art and need not be described in great detail. Generally speaking, they comprise a software package operating a collection of hardware devices including a keyboard, monitor, barcode scanner, weight scale, and electric payment terminal device. The point of sale terminal reads in objects, usually by barcode or unique identification number and optionally by weight, as they are presented to a cashier and keeps a running total payable for purchased products.

The bottom storage area of the shopping cart refers to a flat storage area, typically just above the wheels, which runs the length of the shopping cart and is located underneath the main package storage area. This area is a concern for retail managers because it is often obscured from the cashier's view. Therefore, items placed on the bottom of the cart may be missed by the cashier and losses may be incurred by a store.

Losses through missed items on the bottom of the cart can occur for a number of different reasons. The customer may forget that there is an item on the bottom of the shopping cart and either is never aware that the item has not been properly processed through the store's Point Of Sale system or decides not to return to the store once they are aware of the unprocessed items.

Alternately, an unscrupulous customer may attempt to hide the existence of items located on the bottom of the buggy. This can be accomplished in many different fashions, including: covering the bottom of the main package storage area with a flyer or articles of clothing so as to shield the bottom of the buggy from the cashier's view; placing articles of clothing over top of items located on the bottom of the shopping cart, concealing the items underneath; pushing the shopping cart through the checkout aisle quickly enough so as not to give the cashier time or opportunity to check the bottom of the shopping cart.

Yet further, some cashiers may be negligent in their duty to practice due diligence in checking for items in the bottom of the shopping cart. Worse yet, unscrupulous cashiers may act in coercion with customers known to them personally and purposely not process items placed on the bottom of the shopping cart, in effect defrauding the retailer. This is often referred to as a form of "sweet hearting".

The retail industry, most notably the retail grocery industry, has long suffered these types of losses despite the several inventions designed to reduce them. For example, U.S. Pat. No. 5,485,006 issued to Allen describes a detection mechanism that uses photodetectors to detect the presence of objects located on the lower storage section of a shopping cart as it moves past a checkout station, an audio and/or video alarm for alerting the cashier to the detected object, and a video camera for recording a video image of the object that was detected. Allen discloses that once the alarm state is entered, the cash register draw is commanded to close, thereby preventing any further transactions. The alarm state remains until nullified by depressing a push-button at the checkout station. However, locking the cash register typically occurs after the customer has been checked out. Therefore, the cashier may not notice that there is an item on the lower storage cart until it is too late, The cashier would then have to ring the items in separately which is time consuming and tedious for both the cashier and customer.

Another example of a prior art attempt to solve this problem is described by U.S. application Ser. No. 2003/0184440, filed by Ballantyne. The application describes an item detection apparatus that uses an optical line generator, an area-imaging sensor, and a pattern analyzer to determine the presence or absence of items on the bottom tray of a cart as it moves through a checkout aisle. The pattern-recognition algorithm used by the pattern analyzer determines a differential image process to remove the impact of ambient lighting on the analysis. If an item is detected on the bottom tray of the cart, an audible alarm may be triggered and a secondary system, such as a wheel brake, may be activated that physically prevents further movement of the cart through the checkout aisle. Similar to the previous solution, the cashier may not notice that there is an item on the lower storage cart until it is too late. The cashier would then have to ring the items in separately which is time consuming and tedious for both the cashier and customer.

Further, Canadian Patent No. 2,283,382 issued to Ballantyne describes an inspection apparatus that uses a sensor for detecting the presence of a shopping, a video camera for capturing an image of the lower portion of the shopping cart, and an image display for displaying the image to the cashier. If the presence of a shopping cart is detected, the image of the lower portion of the shopping cart is displayed on the image display. The image display remains until the cash register drawer is closed. The present solution simply displays the bottom of the buggy to the cashier while the transaction is taking place. Typically, however, as the cashiers become accustomed to the display, they will begin to pay less attention to it, reducing its effect.

Yet another example of prior art attempt to solve this problem is described by U.S. Pat. No. 5,883,968 issued to Welch. The patent describes a fraud-detection system that uses a colour video camera to identify the items that are contained in a shopping cart. The system uses a colour-normalization technique to improve the accuracy of the item identification process. The system also takes an overhead image of the checkout station and the adjacent cart aisle to determine whether the shopping cart is empty. If, at the end of the transaction, the shopping cart is found to be not empty, the system determines whether the transaction involved the purchase of any items that are considered to be too large to be placed on the take-away belt of the checkout station. An "event" is generated if the shopping cart is found to be not empty, but the transaction record contains no "large" items. However, the patent does not explain the ramifications of such an event being generated.

Accordingly, even with such a proliferation of solutions, Bottom Of Buggy product detectors have achieved only a very limited success in the marketplace since there has been a continuing need for improvement. Accordingly, it is an object of the present invention to obviate or mitigate at least some of the aforementioned disadvantages.

SUMMARY OF THE INVENTION

In accordance with an aspect of the present invention there is provided a method of facilitating a checkout at a shopping cart checkout station, comprising the steps of: inhibiting processing of items on the shopping cart in the event of a detection of a non-empty obscured section of the shopping cart; and processing the items upon receipt of a command input from an operator at the checkout station.

In accordance with a further aspect of the present invention, there is provided a shopping cart checkout station, comprising: detector for detecting a non-empty obscured section of a shopping cart, the detector being configured to generate a halt command upon the detection of the non-empty obscured section; and computer processor for processing items on the shopping cart for checkout, the processor being in communication with the detector and being configured to inhibit the processing of the items on the shopping cart upon receipt of the halt command from the detector.

BRIEF DESCRIPTION OF THE DRAWINGS

An embodiment of the present invention will now be described by way of example only with reference to the following drawings in which.

DETAILED DESCRIPTION OF THE PREFERRED EMBODIMENT

Figure 1:
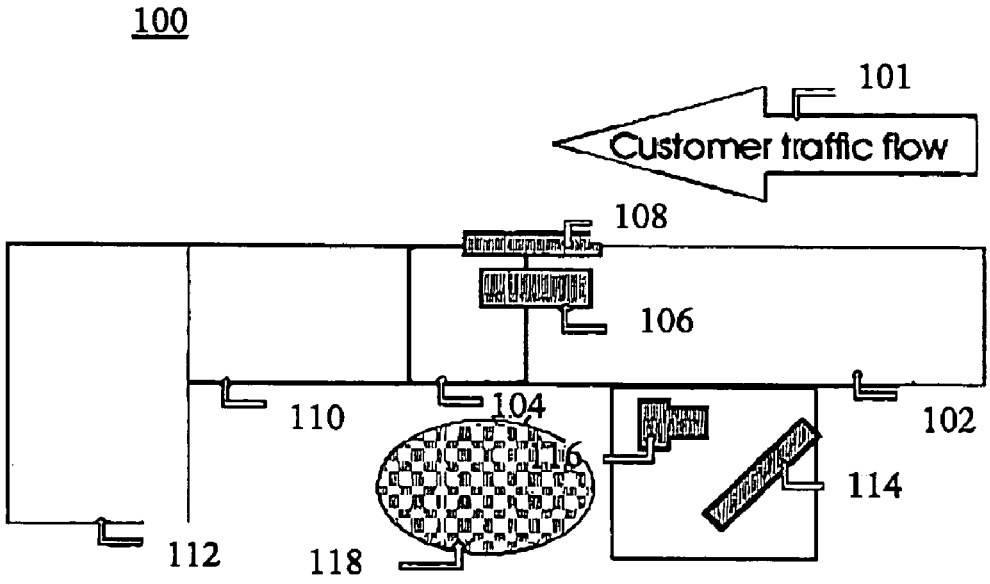
FIG. 1 is a top view of a checkout counter.

For convenience, like numerals in the description refer to like structures in the drawings. Referring to FIG. 1, an overhead view of a checkout station (or counter) is illustrated generally by numeral 100. The checkout counter 100 comprises an entry counter or conveyor belt 102, a combination weight scale/barcode scanner 104, a keyboard 106, a cashier display monitor 108, an exit counter or conveyor belt 110, a bagging area 112, a customer display monitor 114, a handheld barcode scanner 116 and a cashier workspace 118.

Typically, customer traffic flows as indicated by arrow 101 in FIG. 1, as each customer passes through a cashier lane The general process is described as follows. The customer removes their products from the shopping cart and places them on the entry counter or moving conveyor belt 102.

The cashier is then responsible for passing all items past the combination weight scale/barcode scanner 104 for scanning or weighing the items as required. This operation is typically part of the Point Of Sale system and under control of the point of sale software. The handheld barcode scanner 116, which is also part of the Point Of Sale system provides the cashier with the ability to scan barcoded items that are too big to be passed through the combination weight scale/scanner 104. The handheld barcode scanner 116 is typically on a cord long enough for the cashier to reach over the counter 100 and access the product.

Further, the cashier may need to enter information for non-barcoded items, such as produce for example. Accordingly, the cashier uses the keyboard 106 to enter their Product Look Up (PLU) numbers. The keyboard 106 is also used for entering miscellaneous Point Of Sale information such as tender amounts.

While the cashier is checking out the customer's products, information is displayed to the cashier on the cashier display monitor 108. The cashier display monitor 108 is typically a Point Of Sale computer monitor aimed at the cashier, for displaying various items of information about the current transaction, such as a list of items already checked out and a running total of dollar amount of the transaction. The same or similar information is displayed to the customer on the customer display monitor 114.

After the cashier has processed a product through the point of sale system, the cashier typically places the product on the exit counter or conveyor belt 110. The products are moved into the bagging area 112, where they are placed into bags by one or more of the cashier, the customer, or a bagging clerk.

Although the above description illustrates a typical checkout process at a typical checkout counter, various modifications can be implemented. For example, instead of providing both a cashier display monitor 108 and a customer display monitor 114, a single display monitor may perform both functions. Further, the bagging process may differ in that the cashier places the products into bags before placing them onto the exit counter 110. In this case the bagging area 112 may not be necessary. Yet further, the handheld barcode reader 116 may be cordless, or may not be provided at all. These and other modifications will be apparent to a person of ordinary skill in the art.

Figure 2:
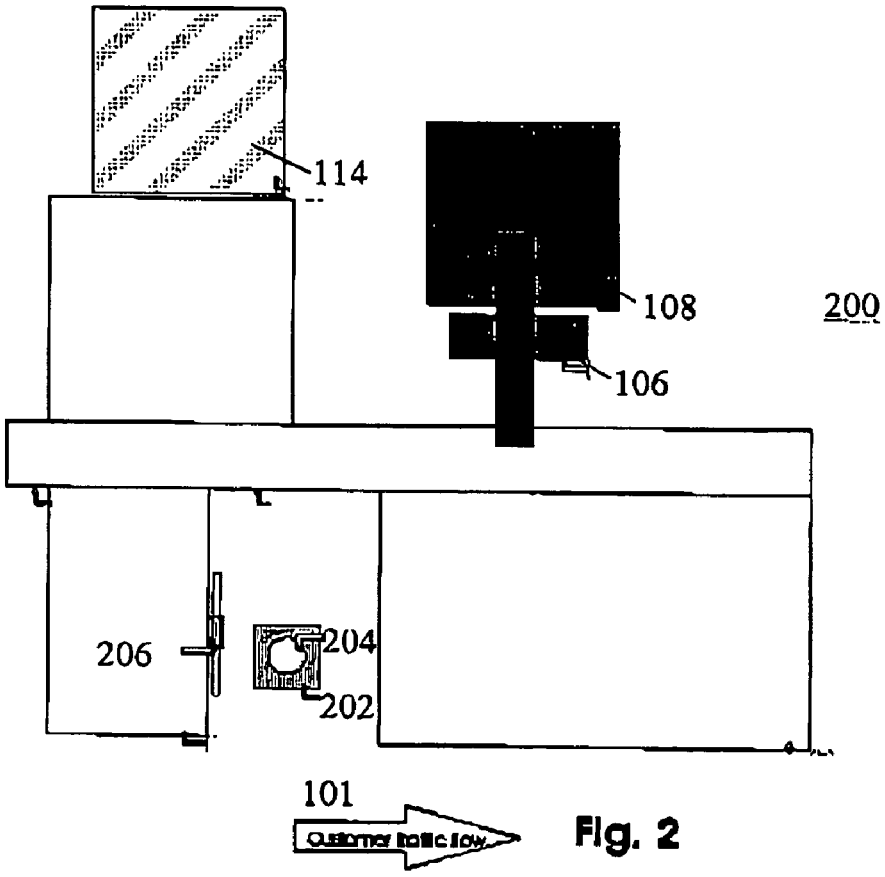
FIG. 2 is a side view of the checkout counter shown in FIG. 1.

Referring to FIG. 2, a side view of the checkout counter 100 illustrated in FIG. 1 is shown. As seen from this perspective, the checkout counter 100 further includes a camera housing 202, a camera view port 204, and a shopping cart barcode reader 206.

The camera housing 202 is used to house a camera (not shown). The camera model used in the present embodiment is the Logitech 4000 Pro web camera. The Logitech camera is a slightly higher end web camera and other cameras such as the Creative PD1130 would likely function equally as well. The camera housing 202 is used both for protecting the camera from physical harm, as well as protecting it from having its angle of view altered after installation. In the present embodiment, the camera housing 202 is bolted down to a rear vertical surface under the checkout counter 100.

The camera housing 202 includes the camera view port 204, which is basically a hole facing out towards the area whereby the shopping cart will pass. The camera is positioned such that its lens aims out of the camera view port 204. The camera view port 204 may also be covered by a clear material such as glass or plastic in order to protect the camera's lens.

The shopping cart barcode reader 206 comprises a laser beam barcode reader and is mounted so that the laser beam, which scans the barcodes, is in a generally vertical configuration. The laser beam is directed towards the area through which the shopping cart will pass for reading a barcode affixed to the shopping cart.

The camera housing 202 and the shopping cart barcode reader 206 are spaced apart such when the shopping cart barcode reader 206 detects a barcode on the shopping cart, the lower level storage area of the shopping cart will be positioned in from of the camera.

Figure 3:
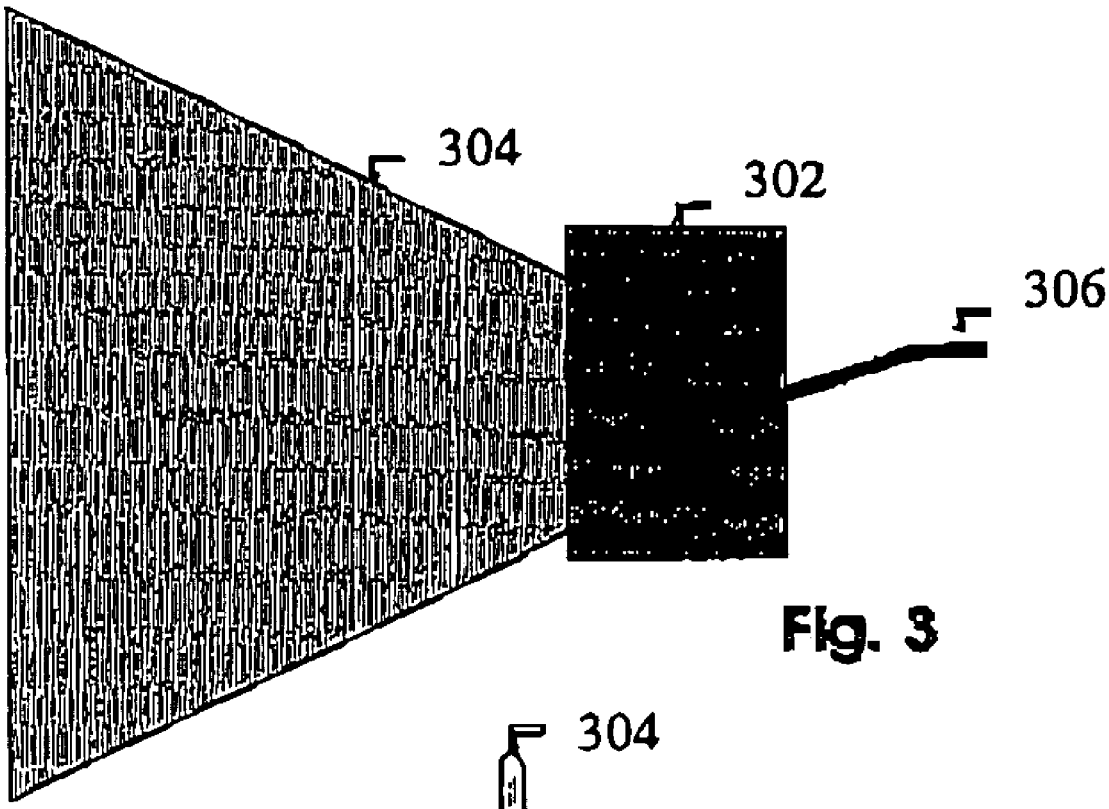
FIG. 3 is a side view of a shopping cart barcode scanner.

Referring to FIG. 3, a side view of the shopping cart barcode reader 206 is shown. In the present embodiment, the shopping cart barcode reader 206 comprises a scanner 302, a laser beam 304, and a cord assembly 306. The cord assembly includes a power cable and a communications cable. The cord assembly 306 leads into an interface/junction box, which splits the power and communications into two separate cables. The cord assembly 306 exits from the rear of the scanner 302 and is typically attached to the checkout counter to avoid causing problems.

Figure 4:
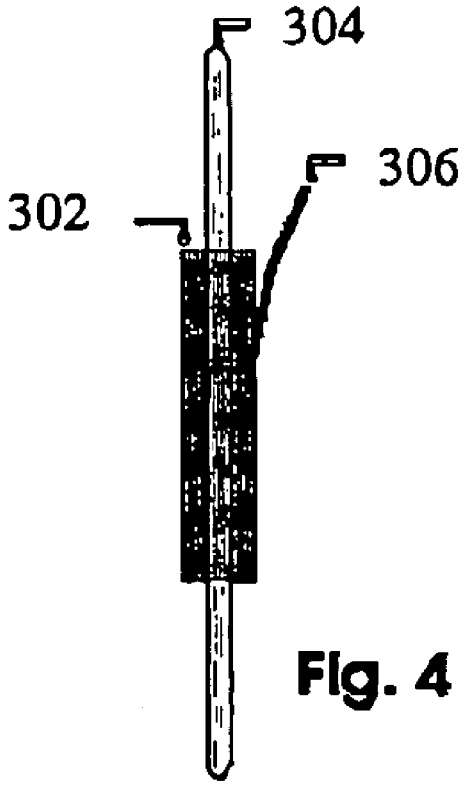
FIG. 4 is a front view of the shopping cart barcode scanner shown in FIG. 3.

As can be seen from the drawing, the laser beam is emitted from the scanner 302 towards the cashier aisle through which the shopping cart will be passing. Referring to FIG. 4 a front view of the shopping cart barcode reader is shown. In this figure the laser beam 304 being emitted from the barcode scanner is aimed directly at the viewer.

All shopping carts in the store are affixed with a barcode. The barcode is placed on the cart such that it can be scanned by the shopping cart barcode reader 206. In the present embodiment, the barcode is placed on the lower storage level of the shopping cart. Further, it is preferable that the location of the barcode for shopping carts of similar size and shape is similar.

The actual barcodes affixed to the shopping cart can vary depending on the implementation. For example, all shopping carts may share a common barcodes or each shopping cart may have a unique barcode. In the present embodiment, the shopping carts have unique barcodes comprising a common five-digit prefix.

Figure 5:
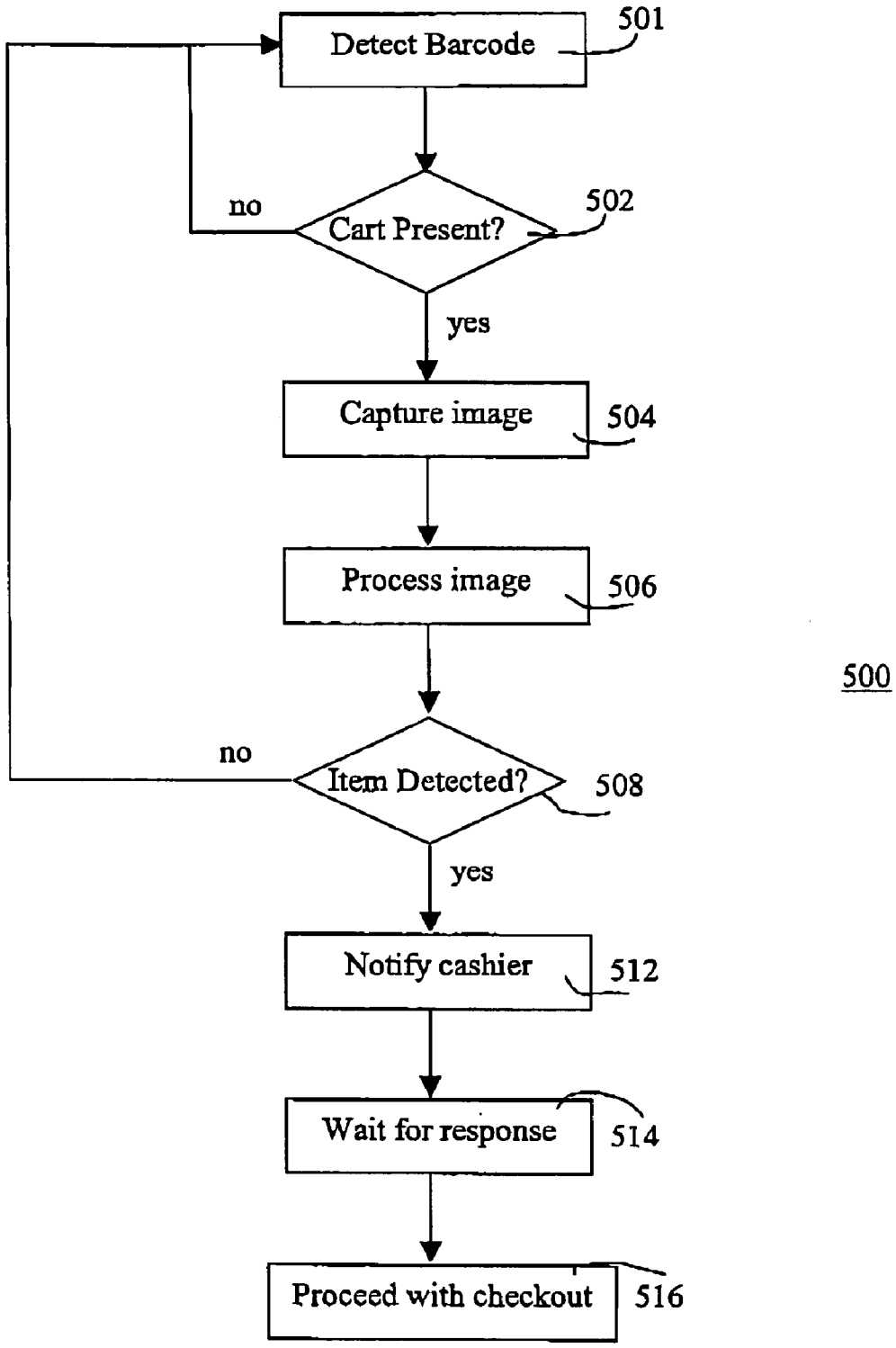
FIG. 5 is a flow chart illustrating operation of the checkout counter in accordance with an embodiment of the invention.

Referring to FIG. 5, the checkout process in accordance with the present embodiment is illustrated generally by numeral 500. In step 501, the shopping cart barcode scanner 206 scans for a shopping cart barcode to pass in front of it. Once a barcode is detected, the process proceeds to step 502 where several tests are, optionally, performed on the barcode to verify the presence of a shopping cart. These tests are described as follows.

The barcode may be verified to ensure that the prefix of the shopping cart barcode matches the predefined common prefix assigned to all shopping carts. Further, the barcode may be checked to ensure that it differs from the previously scanned shopping cart barcode. This reduces any adverse effects of the same shopping cart being moved back and forth in front of the scanner during the same transaction. Duplicate entries may be checked by control logic contained in the scanner itself, or the software used to implement the checkout process. If either of these tests fails, the process returns to step 501, otherwise it continues to step 504.

When the barcode is detected the process proceeds to step 504. In step 504, the camera takes a picture of the lower storage area of the shopping cart and captures the image. Once again, the placement of the camera in relation to the shopping cart barcode scanner 206 and the barcode affixed to the shopping cart result in the camera taking the picture as soon as the barcode is detected.

The process then proceeds to step 506, wherein the captured image is processed to determine whether or not a product is present on the lower storage area of the cart. The image processing is performed as follows. A predefined region is specified within the camera's view area for analysis. Typically, this is the region in which the product would be located. Anything in the captured image appearing outside of this region is ignored for the purposes of image analysis.

The image is converted to a saturated, 256 grayscale image to assist with the image processing. Although the image is captured in colour, the image processing is performed in grayscale for increasing the processing accuracy. When an image is converted into saturated grayscale, details such as textures and patterns are washed out, while edges are emphasized. This allows features such as the wire grating of the shopping cart itself or the lines of tile on a floor, to be practically ignored when comparing images, so items on the bottom of the cart are emphasized. It also reduces the effects of varying light conditions.

The converted image is compared against a stored image, also a saturated 256 grayscale image, of an empty shopping cart. The stored image is not necessarily stored as a saturated grayscale image, but may be converted from a colour image during a system startup routine. The differences between the images are analysed using a Mean Square Error formula Although other image comparison algorithms may also be used effectively, this method protects the process from varying light conditions that are common throughout the day in a retail store where outside lighting affects the quality and hue of the light indoors. The image processing used in the present embodiment is provided Intrepid Control Systems. The Mean Square Error algorithm is applied to the captured and stored images to determine whether or not an item exists within the predefined region.

In step 508, once the comparison has been made, the process determines whether or not an item was detected on the lower storage area of the cart. If no item was detected, the process returns to step 502 and waits for the next shopping cart.

If an item was detected, the process continues to step 512, where the cashier is notified of existence of an item on the bottom of the shopping cart. In the present embodiment the cashier is notified via a popup window that displays an image of the item, captured by the camera, on the cashiers display screen 108.

Further, in addition to displaying an image of the item, the Point Of Sale terminal is halted. Accordingly, the cashier is prevented from any further processing of the transaction, including scanning items or tendering the sale, until that notification screen is acknowledged by the cashier.

In the present embodiment, operation of the point of sale terminal is halted as follows. When the notification screen is sent to the cashier, a "PostMessage" Windows® API call is made to the point of sale terminal with the following parameters to deactivate the scanning equipment: the parameter "wParam" is set to 1; the parameter "msg" is set to a unique id obtained through the Windows® API call "RegisterWindowMessage"; and the parameter "lParam" is set to a pointer addressing the barcode of the shopping cart. In this manner, not only in the transaction halted, but the point of sale terminal is updated with the barcode of the corresponding shopping cart.

In step 514, the process pauses until the cashier provides acknowledgement of the existence of items on the bottom of the shopping cart. In the present embodiment, this is achieved by pressing a predefined key on the keyboard 106.

Once the key has been pressed, the process continues to step 516 in which the point of sale terminal is allowed to proceed as normal. In the present embodiment, the point of sale terminal is reactivated using a second "PostMessage" Windows® API call with the following parameters: the parameter "wParam" is set to 0; the parameter "msg" is set to a unique identifier obtained through the Windows® API call "RegisterWindowMessage"; and the parameter "lParam" is set to null.

If the cashier determined that the item on the bottom storage area of the shopping cart was not a product sold by the store, for example the customer's purse, the cashier can continue to scan the remaining items, if any. Alternately, if the cashier determined that the item on the bottom storage area of the shopping cart was product sold by the store, the cashier can scan the product and then continue to scan the remaining items, if any.

For the present embodiment, the software required to implement the process is stored on the point of sale Terminal, but is separate from the point of sale software. This provides flexibility to integrate the process with various types of point of sales terminals.

Accordingly, it can be seen that the present embodiment provides a store manager with a tool for alerting cashiers to potential products stores in the lower level storage area of a shopping cart. The method forces the cashier to take note of the lower level storage area of a shopping cart if an item is detected, and allows the cashier to easily include the product in the transaction.

In an alternate embodiment, further control is exercised by the store manager by providing a central computer for monitoring all of the point of sale terminals. In the present embodiment, all the point of sale terminals are connected via a network to the central computer. As described in the previous embodiment, the bottom storage area of the shopping cart is scanned for items. When an item is detected, in addition to displaying the item image to the cashier, the item image is communicated from the point of sale terminal to the central computer. In addition to the item image, other information may be transmitted as well including the date, time, a point of sale terminal identifier, a cashier identifier, shopping cart barcode, a list of items checked out, and the like.

Depending on the implementation, shopping cart barcodes can be linked to the transaction by one of the following two methods. In a first method, the barcode scanned by the shopping cart barcode scanner 206 is sent to the Point Of Sale terminal to be stored, along with the transaction, in the Point Of Sale database.

In a second method, the shopping cart includes an additional copy of the barcode on an upper portion of the cart. The cashier can then scan the additional barcode, using the handheld scanner 116, which is connected to and controlled by the Point Of Sale terminal.

Accordingly, it can be seen that storing a list of items checked out along with the picture of the bottom of the cart for later review by a store manager will likely discourage cashiers from attempting to ignore, purposefully or otherwise, detection of items on the lower storage area of the shopping cart.

Further, the shopping cart serial numbers can be shown on customer transaction receipts as well as stored in Point Of Sale historical databases on the central computer for later review. This indicates to the customer that the retailer has technology in place to safe guard against unpaid items, which are placed on the bottom of the shopping cart, leaving the store. Additionally, the customer display monitor 114 may be configured to display a notice to the customers indicating that this type of technology is in place. Such warnings may deter some customers from trying to sneak products through the checkout counter.

Additionally, having a record of the shopping cart serial numbers provides a digital record for the retailer to identify which shopping cart left the building with which customer. Such information would be valuable where once missing carts are retrieved throughout the neighborhood and returned to the retailer.

Therefore, it can be seen that the central computer provides valuable statistical information tracking all shopping cart movement, and making all images available for analysis. Further it can be seen that by recording point of sale transaction information along with an item's image, and forcing a cashier to acknowledge these transactions by interrupting a point of sale terminal's operation, a store manager has a tool to hold cashiers accountable for products placed on the bottom of shopping carts that move through their checkout station.

Additionally, having a record of shopping cart traffic as they move through the cashier stations, regardless of an item detected or not, allows the store manager to monitor the health of their shopping cart inventory. Furthermore, head office personnel are presented with a tool that may assist in transferring shopping cart inventory out of one store and into another. For example, if the cart traffic data shows that 20 percent of the carts get used 80 percent of the time, it may indicate that there is an excess of shopping carts at a particular location. This provides the store with an opportunity to save money by transferring carts to a different store location that is in need, instead of ordering new carts. Likewise, if the reverse were true, it would indicate that there is a shortage of shopping carts.

Yet further, cart traffic data may also indicate problem carts. If a cart has not been pushed through a cashier station for quite some time, typically well below the store average rate, it may indicate a cart is in need of repair.

Although the previous embodiments have been described as detecting items stored on the lower storage area of the cart, the present invention is not limited as such Rather, the invention can be equally applied to another area that may be obscured from the cashier's view, as will be appreciated by a person of ordinary skill in the art.

While the invention has been described in connection with a specific embodiment and in a specific use, various modifications will occur to those skilled in the art without departing from the spirit of the invention.

The terms and expressions which have been employed in the specification are used as terms of description and not of limitations, there is no intention in the use of such terms and expressions to exclude any equivalents of the features shown and described or portions thereof, but it is recognized that various modifications are possible within the scope of the invention. The present invention is intended to be defined according to the following claims and their equivalents.

What is claimed is:

1. A method of facilitating a checkout at a shopping cart checkout station, comprising the steps of:

detecting a non-empty obscured section of a shopping cart at the checkout station;

generating a halt command;

inhibiting further processing of items on the shopping cart by the checkout station in response to the halt command presenting a notification to an operator of the checkout station in response to the halt command, the notification indicating that further processing has been inhibited;

receiving an acknowledgment from the operator of the checkout station in response to the notification; and continuing to process a remainder of the items upon receipt of the acknowledgment.

2. The method according to claim 1, wherein the process inhibiting step comprises the step of inhibiting scanning of the items at a point of sale terminal at the checkout station.

3. The method according to claim 2, wherein the displaying a notification step comprises the steps of displaying an image of the non-empty obscured section on the point of sale terminal.

4. The method according to claim 3, wherein the image is displayed until receipt of the acknowledgment from the operator.

5. The method according to claim 3, wherein the obscured area comprises a lower section of a shopping cart, and the step of detecting the non-empty obscured section comprises detecting an object at the lower section.

6. The method according to claim 5, wherein the point of sale terminal is in communication with an image processor, and the step of detecting the object comprises detecting the object with the image processor.

7. The method according to claim 6, wherein the image processor comprises a saturated gray-scale image processor.

8. The method according to claim 6, wherein the image processor includes a camera directed towards the lower section, and the step of detecting the object comprises securing a single image of the lower section with the camera upon the detecting the presence of the shopping cart.

9. The method according to claim 8, wherein the step of detecting the object comprises comparing the single image against a reference image of an empty shopping cart, and inhibiting the processing in accordance with the comparison.

10. The method according to claim 8, wherein the shopping cart is configured with a visual identifier, and the step of detecting the presence of the shopping cart comprises detecting the visual identifier.

11. The method according to claim 10, wherein the visual identifier comprises a barcode, and the step of detecting the shopping cart comprises detecting the presence of the barcode with a barcode reader.

12. The method according to claim 1, further comprising the step of storing information about the checkout at a central computer.

13. The method according to claim 12, wherein the information comprises one or more of a checkout station identifier, cashier identifier, transaction details, an image of the obscured section of the shopping cart and a shopping cart barcode.

14. A shopping cart checkout station for checking out of items in a shopping cart, comprising:

a detector for detecting a non-empty obscured section of a shopping cart, the detector being configured to generate a halt command upon the detection of the non-empty obscured section;

a user interface in communication with the detector, the user interface configured to:

present a notification to an operator of the checkout station in response to the halt command, the notification indicating that processing of items in the shopping card has been inhibited; and receive an acknowledgement from the operator that the notification has been acknowledged; and a processor in communication with the detector and the user interface, the processor for processing items on the shopping cart for checkout, the processor configured to:

inhibit the processing of the items on the shopping cart in response to the halt command from the; and continue processing a remainder of the items on the shopping cart in response to the acknowledgment.

15. The checkout station according to claim 14, further including a display in communication with the processor, and wherein the processor is configured to display an image of the non-empty obscured section on the display.

16. The checkout station according to claim 15, wherein the processor is configured to display the image until receipt of the acknowledgement.

17. The checkout station according to claim 16, wherein the detector includes an image processor for the detection of the objects on the lower section.

18. The checkout station according to claim 17, wherein the image processor comprises a saturated gray-scale image processor.

19. The checkout station according to claim 17, wherein the detector is configured to detect a presence of a shopping cart, and to command the processor to initiate the processing upon the detection of the presence of the shopping cart.

20. The checkout station according to claim 19, wherein the image processor includes a camera directed towards the lower section, and the detector is configured to secure a single image of the lower section with the camera upon the detecting the presence of the shopping cart.

21. The checkout station according to claim 20, wherein the detector is configured to detect the objects by comparing the single image against a reference image of an empty shopping cart, and to transmit an inhibit command to the processor to inhibit the processing in accordance with the comparison.

22. The checkout station according to claim 20, wherein the shopping cart is configured with a visual identifier, and the detector is configured to detect the presence of the shopping cart by detecting the visual identifier.

23. The checkout station according to claim 22, wherein the visual identifier comprise a barcode, and the detector comprises a barcode reader for detecting the presence of the barcode.

24. The checkout station according to claim 15, wherein the obscured area comprises a lower section of a shopping cart, and the detector is configured to detect objects on the lower section.

25. The checkout station according to claim 15, wherein the information comprises one or more of a checkout station identifier, cashier identifier, transaction details, an image of the obscured section of the shopping cart and a shopping cart barcode.

26. The checkout station according to claim 14, further comprising a central computer coupled via a network for storing information about the checkout.

27. An apparatus for facilitating a checkout of items in a shopping cart at a computer-based checkout station, the apparatus comprising:

a detector for detecting a non-empty obscured section of the shopping cart at the checkout station; and a communication interface for interfacing the detector with the checkout station, the communication interface being configured to:

command the checkout station to halt processing of the items upon the detection of the non-empty obscured; and command the checkout station to continue processing the items upon the receipt of an acknowledgment.

28. The apparatus according to claim 27, wherein the communication interface is further configured to command the checkout station to notify an operator of the detection of the non-empty obscured section.

29. The apparatus according to claim 28, wherein the checkout station includes a display, and the communication interface is configured to command the checkout station to display an image of the non-empty obscured section on the display.

30. The apparatus according to claim 29, wherein the obscured area comprises a lower section of a shopping cart, and the detector is configured to detect objects on the lower section.

31. The apparatus according to claim 29, wherein the detector includes an image processor for the detection of the objects on the lower section.

32. The apparatus according to claim 31, wherein the image processor comprises a saturated gray-scale image processor.

33. The apparatus according to claim 31, wherein the image processor includes a camera directed towards the lower section, and the detector is configured to secure a single image of the lower section with the camera upon the detecting the presence of the shopping cart.

34. The apparatus according to claim 33, wherein the detector is configured to detect the objects by comparing the single image against a reference image of an empty shopping cart, and to transmit a halt command to the communication interface in accordance with the comparison.

35. The apparatus according to claim 33, wherein the shopping cart is configured with a visual identifier, and the detector is configured to detect the presence of the shopping cart by detecting the visual identifier.

36. The apparatus according to claim 35, wherein the visual identifier comprises a barcode, and the detector comprises a barcode reader for detecting the presence of the barcode.

37. The apparatus according to claim 27, further comprising a second interface for coupling to a central computer coupled via a network for storing information about the checkout.

38. The apparatus according to claim 37, wherein the information comprises one or more of a checkout station identifier, cashier identifier, transaction details, an image of the obscured section of the shopping cart and a shopping cart barcode.

* * * * *